US011629307B2

(12) United States Patent
Meijer et al.

(10) Patent No.: US 11,629,307 B2
(45) Date of Patent: Apr. 18, 2023

(54) GREASE COMPOSITIONS AND A METHOD FOR MAKING THE SAME

(71) Applicant: Aktiebolaget SKF, Gothenburg (SE)

(72) Inventors: Dick Meijer, Wageningen (NL); Sathwik Chatra Kalsanka Ramakrishna, Nieuwegein (NL); Dries Muller, Schwaz (AT)

(73) Assignee: AKTIEBOLAGET SKF, Gothenburg (SE)

( * ) Notice: Subject to any disclaimer, the term of this patent is extended or adjusted under 35 U.S.C. 154(b) by 817 days.

(21) Appl. No.: 15/837,117

(22) Filed: Dec. 11, 2017

(65) Prior Publication Data

US 2018/0171256 A1 Jun. 21, 2018

(30) Foreign Application Priority Data

Dec. 15, 2016 (IN) ..... 201641042772

(51) Int. Cl.

| | |
|---|---|
| ***C10M 119/24*** | (2006.01) |
| ***C10M 105/32*** | (2006.01) |
| ***C10M 169/04*** | (2006.01) |
| ***C10M 169/02*** | (2006.01) |
| *C10N 20/02* | (2006.01) |
| *C10N 30/10* | (2006.01) |
| *C10N 40/02* | (2006.01) |
| *C10N 40/04* | (2006.01) |
| *C10N 50/10* | (2006.01) |

(52) U.S. Cl.

CPC ..... *C10M 119/24* (2013.01); *C10M 105/32* (2013.01); *C10M 169/02* (2013.01); *C10M 169/04* (2013.01); *C10M 2207/2805* (2013.01); *C10M 2215/0813* (2013.01); *C10M 2217/0446* (2013.01); *C10N 2020/02* (2013.01); *C10N 2030/10* (2013.01); *C10N 2040/02* (2013.01); *C10N 2040/04* (2013.01); *C10N 2050/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,830,954 | A | 4/1958 | Dixon | |
| 2,830,955 | A | 4/1958 | Dixon | |
| 4,448,700 | A | 5/1984 | Lankamp | |
| 4,720,517 | A | 1/1988 | Ravichandran et al. | |
| 4,749,502 | A | 6/1988 | Alexander et al. | |
| 4,889,938 | A * | 12/1989 | Kristen | C07D 327/02 549/10 |
| 5,023,283 | A | 6/1991 | Ravichandran et al. | |
| 5,578,089 | A | 11/1996 | Elsamaloty | |
| 5,674,567 | A | 10/1997 | Kausch et al. | |
| 5,773,394 | A * | 6/1998 | Wan | C10M 119/02 508/591 |
| 5,783,657 | A | 7/1998 | Pavlin et al. | |
| 5,998,570 | A | 12/1999 | Pavlin et al. | |
| 6,423,304 | B1 | 7/2002 | Shah et al. | |
| 6,489,272 | B2 | 12/2002 | Gatlin | |
| 2002/0187170 | A1 | 12/2002 | Pavlin | |
| 2003/0008782 | A1 | 1/2003 | Endou et al. | |
| 2003/0126788 | A1 | 7/2003 | Uang et al. | |
| 2003/0162938 | A1 * | 8/2003 | Pavlin | C08G 69/34 528/310 |
| 2003/0223943 | A1 | 12/2003 | Uang et al. | |
| 2004/0121162 | A1 | 6/2004 | Yamaoka et al. | |
| 2005/0205341 | A1 | 9/2005 | Kitahata et al. | |
| 2006/0229222 | A1 | 10/2006 | Muller et al. | |
| 2006/0280763 | A1 | 12/2006 | Yoshida et al. | |
| 2007/0000807 | A1 | 1/2007 | Wu et al. | |
| 2008/0182770 | A1 | 7/2008 | Ramsey | |
| 2009/0065287 | A1 | 3/2009 | Kuwabara et al. | |
| 2010/0117022 | A1 * | 5/2010 | Carr | C10M 171/008 252/68 |
| 2012/0149613 | A1 * | 6/2012 | David | C10M 123/02 977/773 |
| 2013/0006175 | A1 | 1/2013 | Elton | |
| 2013/0130953 | A1 | 5/2013 | Spagnoli et al. | |
| 2013/0331307 | A1 * | 12/2013 | Meijer | C10M 169/06 508/534 |
| 2014/0011718 | A1 | 1/2014 | Meijer et al. | |
| 2014/0113847 | A1 * | 4/2014 | Givens | C10M 149/06 508/468 |
| 2014/0142232 | A1 | 5/2014 | Bond et al. | |
| 2014/0329729 | A1 | 11/2014 | Becker-Willinger et al. | |

(Continued)

FOREIGN PATENT DOCUMENTS

| | | |
|---|---|---|
| CA | 1148926 A | 6/1983 |
| CN | 1670144 A | 9/2005 |

(Continued)

OTHER PUBLICATIONS

Chevron, chevronbaseoils.com (Year: 2013).*

(Continued)

*Primary Examiner* — Prem C Singh
*Assistant Examiner* — Chantel L Graham
(74) *Attorney, Agent, or Firm* — J-Tek Law PLLC; Jeffrey D. Tekanic; Scott T. Wakeman

(57) ABSTRACT

A grease composition comprising a thickener and a lubricating base oil, wherein the lubricating base oil has a viscosity in the range of from 5-1000 cSt (at 40° C.). The thickener is present in an amount of 5-40 wt. %, based on total weight of the grease composition. The thickener comprises an ester terminated oligomer which has the general formula: "R1—O—[CO—R2—CO—NH—R3—NH—CO—R2—CO]n-O—R1". "R1" represents a hydrocarbon group containing 4-22 carbon atoms. "R2" represents a hydrocarbon group containing 4-42 carbon atoms. "R3" represents a hydrocarbon group containing 2-9 carbon atoms. "n" represents an integer in the range of 1-20. The weight ratio between the lubricating base oil and the ester terminated oligomer (oil/oligomer) is larger than 1. The grease composition can be used for lubricating a mechanical component having a metal surface and/or for protecting a mechanical component having a metal surface against corrosion, wear and/or fretting.

20 Claims, No Drawings

(56) References Cited

U.S. PATENT DOCUMENTS

| | | | |
|---|---|---|---|
| 2015/0024981 | A1 | 1/2015 | Ayame et al. |
| 2015/0232778 | A1 | 8/2015 | Arai et al. |
| 2015/0368583 | A1 | 12/2015 | Meijer |
| 2016/0130523 | A1 | 5/2016 | Holsnijders et al. |
| 2017/0321144 | A1 | 11/2017 | Fiddelaers et al. |
| 2017/0343045 | A1 | 11/2017 | Asai et al. |
| 2017/0349854 | A1 | 12/2017 | Nakakawaji et al. |
| 2017/0362527 | A1 | 12/2017 | Fiddelaers et al. |
| 2018/0016517 | A1 | 1/2018 | Sawaguchi et al. |
| 2018/0171260 | A1 | 6/2018 | Ramakrishna et al. |
| 2018/0282654 | A1* | 10/2018 | Abraham ..... C10M 169/06 |

FOREIGN PATENT DOCUMENTS

| | | | |
|---|---|---|---|
| CN | 101622333 | A | 1/2010 |
| CN | 103403138 | A | 11/2013 |
| CN | 105229130 | A | 1/2016 |
| EP | 2053073 | A2 | 4/2009 |
| EP | 2156821 | A1 | 2/2010 |
| FR | 2808281 | A1 | 11/2001 |
| GB | 774085 | A | 5/1957 |
| JP | 2001164282 | A | 6/2001 |
| JP | 2008038047 | A | 2/2008 |
| WO | 9817243 | A1 | 4/1998 |
| WO | 03050164 | A1 | 6/2003 |
| WO | 2014065984 | A1 | 5/2014 |
| WO | 2015016259 | A1 | 2/2015 |
| WO | 2016077134 | A1 | 5/2016 |

OTHER PUBLICATIONS

Combined Search and Examination Report dated Feb. 1, 2016 in related UK application No. GB1513789.6.

Combined Search and Examination Report dated Feb. 2, 2016 in related UK application No. GB1513790.4.

Notice of Allowance dated Nov. 13, 2019 in related application No. 15837127, including examined claims claims 1-8 and 14-25.

Product Brochure of Arizona Chemical entitled "Hot Melt Polyamide Adhesives"; Jul. 2011.

Search Report and Written Opinion from the French Patent Office dated Aug. 10, 2020 in counterpart French application No. 1761784, with attached translation thereof.

Office Action and Search Report from the Indian Patent Office dated Mar. 17, 2021 in counterpart Indian patent application No. 201641042772.

Office Action dated Jun. 15, 2021 in counterpart CN application No. 201711334153.X, and English translation thereof.

Office Action dated Jun. 15, 2021 in related CN application No. 201711318501.4, and English translation thereof.

* cited by examiner

GREASE COMPOSITIONS AND A METHOD FOR MAKING THE SAME

CROSS-REFERENCE OR RELATED APPLICATIONS

This application claims priority to Indian patent application no. IN 201641042772 filed on Dec. 15, 2016, the contents of which are fully incorporated herein by reference.

FIELD OF THE PRESENT INVENTION

The present invention relates to a grease composition; and a method for preparing the grease composition. The invention also relates to the use of the grease composition for lubricating a mechanical component having a metal surface; and the use of the grease composition for protecting a mechanical component having a metal surface against corrosion, wear and/or fretting.

BACKGROUND

Grease compositions are widely used for lubricating bearings and other structural components. Grease is an essential product to reduce, for example, wear, friction, corrosion, running temperatures and energy losses.

Greases are materials which comprise a base oil that is thickened, for example using a metal soap or calcium sulfonate as thickening agent. This provides greases with the desired physical and chemical structure needed for sustained lubrication of machine elements under rolling or sliding conditions, as is the case in rolling bearings. There are a number of grease thickeners available, each with its own strengths and weaknesses. Briefly, typical lithium-based greases (the most common) are made from a fatty acid, usually 12-hydroxystearic acid, and a lithium base to produce a simple soap which acts as the grease thickener. In lithium-complex greases, part of the fatty acid is replaced with another acid (usually a diacid), which makes the complex soap. Calcium sulfonate greases can be used as an alternative for soap-based greases. They have the potential of providing high performance without the presence of additives.

Components are added to grease to provide essential extreme-pressure/anti-wear performance, and other desirable properties that allow equipment to run at peak performance. The function of such additives is to minimize wear, and to prevent scuffing and welding between contacting surfaces. Additives may also form a friction-reduction film following the physical-chemical reaction of the additives on the lubricated metal surface, resulting in desired properties of reducing friction and operating temperature.

An important performance benefit of grease compositions lies in the use of synergetic components. It is highly desirable that the additives incorporated, but also the thickening agent, (i) provide a synergetic improvement of different properties such as extreme pressure/anti-wear properties, friction reduction, and corrosion protection; (ii) prevent a negative impact on other properties, for example lubricant film formation, or grease mechanical stability, or low temperature performance, (iii) achieve the desired performance at the lowest possible overall additive concentration.

In many applications, exposure to water or high humidity levels requires the use of greases that are highly effective in protecting against corrosion. Anti-corrosion additives are often surfactants that neutralize acids on the surface of metal. These can also repel water by creating absorption to form an oil-like surface, or by providing a barrier through incorporation in a physical-chemical surface-film.

Conventional greases such as lithium 12-hydroxide stearate-based grease compositions leave room for improvement in terms of anti-friction and anti-corrosion properties. Due to the strong polar interaction between thickener and lubricated surface, the effectiveness of grease additives is reduced, or alternatively, effective performance can only be achieved by increasing the additive concentration.

Calcium sulfonate thickened greases can be used as an alternative for soap-based greases. They have the potential of providing high performance without the presence of additional additives, owing to the interaction with the metal surface, and the neutralizing ability, of the calcium sulfonate thickener. They combine properties of a good mechanical stability, very strong extreme-pressure/anti-wear performance, and excellent rust protection. Although calcium sulfonate greases have desirable properties, the downside is the high concentration of calcium sulfonate concentration needed to thicken the grease, as well as raw material cost. The thickener concentration may vary to values as high as 20 to 50 percent in greases.

Conventional grease compositions have the additional drawback, that due to mechanical shearing they become in the course of time a permanent liquid, resulting in a deterioration of their lubricating performance.

In grease-lubricated bearings, lubrication conditions deteriorate over time due to grease hardening, grease aging, and oil depletion from grease fractions stored close to the rolling contact. It is generally acknowledged that greases are sensitive to physical and chemical ageing, and that this is an irreversible process. Inherent properties of greases, therefore, are a loss of effectiveness in replenishing the rolling contact.

In bearings, greases suffer from a (relatively) unfavorable grease distribution, where a small fraction positioned close to the rolling contact drives the lubrication performance, while a larger fraction of grease is inactive in the lubrication process. Essentially, this leads to insufficient grease/oil replenishment in applications in due time. Due to grease ageing/hardening, replenishing grease by re-lubrication can be difficult.

BRIEF SUMMARY OF THE PRESENT INVENTION

Object of the present invention is to provide a grease composition which displays reversible properties at different shear rates.

It has now been found that that this object can be established when the grease composition comprises a particular thickener.

Accordingly, the present invention relates to a grease composition comprising a thickener and a lubricating base oil, in which the lubricating base oil has a viscosity in the range of from 5-1000 cSt (at 40° C.), wherein the thickener is present in an amount of 5-40 wt. %, based on total weight of the grease composition, wherein the thickener comprises an ester terminated oligomer which has the general formula $$R1—O—CO—R2—CO—[NH—R3—NH—CO—R2—CO]_n—O—R1,$$

wherein R1 each independently represents a hydrocarbon group containing 4-22 carbon atoms; R2 represents a hydrocarbon group containing 4-42 carbon atoms, noting that at least 50% of the R2 groups have 30-42 carbon atoms; R3 represents a hydrocarbon group containing 2-9 carbon atoms, in addition to hydrogen atoms, and optionally containing one or more oxygen and nitrogen atoms; and n represents an integer in the range of 1-20, and wherein the weight ratio of the lubricating base oil to the ester terminated oligomer (oil/oligomer) is larger than 1.

Grease compositions according to the present teachings have the advantage that they exhibit reversible properties at different shear rates. This improvement is established by the mechanical properties of the thickener which bring about less grease ageing. The thickener has the advantage that it becomes a liquid at a high shear rate, whereas it regains its solid form at a low shear rate, resulting in a proper lubricating performance over an extended period of time. As a result, less grease replenishment is required, making the lubricating process much more cost-effective, whilst at the same time the risk of a mechanical breakdown at an early stage is reduced considerably. In addition, the thickener to be used in accordance with the present teachings exhibits excellent solubility in the lubricating base oil. Moreover, grease compositions in accordance with the present teachings have the substantial advantage that they can be used for filling a lubricant reservoir or the unswept space in a rolling bearing without the need for a running-in period that is normally required to avoid high temperature increases.

DETAILED DESCRIPTION OF THE PRESENT INVENTION

The composition according to the present invention comprises a lubricating base oil and a thickener which comprises an ester-terminated oligomer.

Preferably, the present grease compositions comprise:

(a) 75 to 90 wt. % of the lubricating base oil; and (b) 10 to 25 wt. % of the ester-terminated oligomer, all weights based on the total weight of the grease composition.

More preferably, the present grease compositions comprise:

(a) 78 to 82 wt. % of the lubricating base oil; and (b) 18 to 22 wt. % of the ester-terminated oligomer, all weights based on the total weight of the grease composition.

The present grease compositions contain a lubricating base oil having a viscosity in the range of from 5-1000 cSt (at 40° C.). Preferably, the present grease compositions contain a lubricating base oil having a viscosity in the range of from 20-600 cSt (at 40° C.), more preferably a viscosity in the range of from 40-400 cSt (at 40° C.).

The thickener is present in an amount of 5-40 wt %, based on total weight of the grease composition. Preferably, the thickener is present in an amount of 10-30 wt %, more preferably in an amount of 18-22 wt %, based on total weight of the grease composition.

In the present grease compositions, the weight ratio between the lubricating base oil and the ester-terminated oligomer (oil/oligomer) is larger than 1. Preferably, the weight ratio between the lubricating base oil and the ester-terminated oligomer (oil/oligomer) is in the range of from 1-8, more preferably in the range of from 1-4.

R1 represents a hydrocarbon group containing 4-22 carbon atoms. The hydrocarbon group may be a straight or branched hydrocarbon group, the hydrocarbon group may a single chain hydrocarbon group or a multiple chain hydrocarbon group; the hydrocarbon group may be a saturated or unsaturated hydrocarbon group; and/or the hydrocarbon group may be a substituted or a non-substituted hydrocarbon group. In case the hydrocarbon group is a substituted hydrocarbon group the hydrocarbon group may contain an additional functional group such as for instance an alcohol or acid group. Preferably, R1 represents an unsubstituted hydrocarbon group.

Preferably, R1 represents a hydrocarbon group which is derived from a monoalcohol. Suitable examples of monoalcohols from which R1 can suitably be derived include stearyl alcohol, palmetyl alcohol, lauryl alcohol and oleyl alcohol. The monoalcohol is preferably stearyl alcohol or oleyl alcohol. More preferably, R1 is derived from stearyl alcohol. Suitably, R1 represents a hydrocarbon group that contains 4-22 carbon atoms, preferably 4-20 carbon atoms and more preferably 4-18 carbon atoms.

R2 represents a hydrocarbon group containing 4-42 carbon atoms. The hydrocarbon group may be a straight or branched hydrocarbon group; the hydrocarbon group may be a single chain hydrocarbon group or a multiple chain hydrocarbon group; the hydrocarbon group may be a saturated or unsaturated hydrocarbon group; and/or the hydrocarbon group may be a substituted or a non-substituted hydrocarbon group. In case the hydrocarbon group is a substituted hydrocarbon group the hydrocarbon group may contain an additional functional group such as for instance an alcohol, ether and/or carboxylic acid group. Suitably, R2 represents a hydrocarbon group that is substituted with a carboxylic acid group.

Preferably, R2 represents a hydrocarbon group which is derived from a diacid, a triacid, a dimer acid or a trimer acid. Preferably, R2 represents a hydrocarbon group which is derived from a diacid. Suitable examples of diacids from which R2 can suitably be derived include from glutaric acid, adipic acid, pimelic acid, azeliac acid, sebacic acid or brassylic acid. Preferably, R2 is derived from adipic acid, pimelic acid, azeliac acid, sebacic acid or brassylic acid. More preferably, the diacid is derived from azeliac acid or sebacic acid. The dimer acid is preferably derived from two molecules of stearic acid or oleic acid. Suitably, R2 represents a hydrocarbon group that contains 4-42 carbon atoms, preferably 4-40 carbon atoms and more preferably 4-36 carbon atoms.

Suitable examples of dimer acids include dicarboxylic acids that have been derived from two monomers of fatty acids that each contains 14 to 22 carbon atoms such as oleic acid, behenic acid, palmitic acid, linoleic acid, stearic acid or linoleinic acid. Preferably, the dimer acid has been derived from two monomers of oleic acid, behenic acid, palmitic acid, linoleic acid, stearic acid, linoleinic acid, and any combination thereof. Preferably, the dimer acid has been derived from stearic acid or oleic acid. More preferably, the dimer acid is preferably derived from two molecules of stearic acid or oleic acid. The diacid is suitably selected from the group consisting of suberic acid, pimelic acid, adipic acid, azeliac acid, sebacic acid and brassylic acid. The diacid is in that case preferably adipic acid, azeliac acid or sebacic acid.

Suitably, use is made of dimer acids or trimer acids that are obtained from polymerization of fatty acids. Polymerized fatty acids are typically a mixture of structures, where individual molecules may be saturated, unsaturated, or cyclic. Typically, unsaturated fatty acids are used to form dimer acids, and these include oleic acid, linoleic acid, and linolenic acid. Following the polymerization process, dimer acids may be hydrogenated to remove remaining unsaturation from the hydrocarbon chain. In the dimer acids or trimer acids to be used in accordance with the present invention the two or three carboxylic acid groups are present in the different fatty acid chains of which the dimer acid or trimer acid consists. Hence, these dimer acids and trimer acids differ essentially from diacids or triacids in which two or three carboxylic acid groups are respectively present in one single chain.

In a particularly attractive embodiment of the present invention, the ester terminated oligomer contains both R2 hydrocarbons groups that are derived from one or more dimer acids and one or more diacids, and the molar ratio (A/B) between R2 hydrocarbons groups that are derived from dimer acids (A) and the R2 hydrocarbon groups that are derived from diacids (B) is larger than 1, preferably larger than 2, and more preferably in the range of from 2.5-2.9.

Preferably, the ester terminated oligomer contains one type of dimer acid and one type of diacid.

Preferably, at least 50% of the R2 hydrocarbon groups are derived from a dimer or trimer. An important aspect of the ester-terminated oligomer used herein is its use in lubricating compositions containing low polarity lubricating base oils.

Suitably, R2 represents a hydrocarbon group containing 4-44 carbon atoms. R2 is preferably selected from a C4-42 hydrocarbon group. Preferably, R2 represents a hydrocarbon group containing 28-44 carbon atoms. Preferably, at least 50% of the R2 hydrocarbon groups present in the ester terminated oligomer have 30-42 carbon atoms.

The ester-terminated oligomers may also be derived from carboxylic acids which contain less than 28 carbon atoms. Grease compositions of the present invention comprise oligomers that may be derived from carboxylic acids which contain 4-16 carbon atoms, preferably 4-12 carbon atoms, and more preferably 6-9 carbon atoms. Preferably, the carboxylic acid from which the ester terminated oligomer is derived consists of less than 50 wt. %, more preferably less than 30%, and more preferably less than 12 wt. % of these shorter carboxylic acids.

R3 represents a hydrocarbon group containing 2-9 carbon atoms. The hydrocarbon group may be a straight or branched hydrocarbon group; the hydrocarbon group may be a single chain hydrocarbon group or a multiple chain hydrocarbon group; the hydrocarbon group may be a saturated or unsaturated hydrocarbon group; and/or, the hydrocarbon group may be a substituted or a non-substituted hydrocarbon group. In case the hydrocarbon group is a substituted hydrocarbon group the hydrocarbon group may contain an additional functional group such as for instance an alcohol or acid and/or an amine group. Preferably, R3 represents an unsubstituted hydrocarbon group. Preferably, R3 represents a hydrocarbon group which is derived from a diamine or triamine. R3 is selected independently from an organic groups containing at least 2 carbon atoms in addition to hydrogen atoms, an optionally containing one or more oxygen and nitrogen atoms.

Suitable examples of diamines include ethylene diamine, 1,2-propylene diamine and 1,3-propylene diamine, tetramethylene diamine, hexamethylene diamine, octamethylene diamine, 1,2-diaminocyclohexane, 1,3-bis(aminomethyl)cyclohexane, diphenylethylene diamine, ortho, meta phenylenediamine, 2,5-diaminotoluene dimethyl-4-phenylenediamine, N,N'-di butyl-1,4-phenelyenediamine, 4,4-diaminobiphenyl, and 1,8-diaminonaphthalene, and any combination thereof. Preferably, the diamine is ethylene diamine, hexamethylene diamine, 1,2-propylene diamine and 1-3-propylene diamine, or ortho-/meta-phenylene diamine, and any combination thereof. More preferably, the diamine is ethylene diamine or hexamethylene diamine.

Suitable examples of triamines include polyoxypropylenetriamine polyetheramine, and Glyceryl poly(oxypropylene) triaminepolyetheramines, with weight average molecular weights of 3000 to 5000 Dalton, or any combination thereof.

Suitably, R3 represents a hydrocarbon group that contains 2-9 carbon atoms, preferably 2-6 carbon atoms and more preferably 2-3 carbon atoms.

The ester terminated oligomer to be used in accordance with the present invention has suitably an acid number of less than 50, preferably less than 30, and more preferably less than 15.

The molecular weight of the ester terminated oligomer is suitably in the range of from 900-23300 Dalton, preferably in the range of from 920-23250 Dalton, and more preferably in the range of from 934-23221 Dalton.

The ester-terminated oligomer in accordance with the present invention is an oligomer having ester end groups. The ester terminated polymer to be used in accordance with the present invention can suitably derived from a two-steps process, in which in a first step an excess of carboxylic acid selected from the group consisting of diacids, triacids, dimer acid and trimer acids, is reacted with an amine selected from the group consisting of diamines and triamines, to form an acid-terminated oligomer. In order to establish this use is made of a molar excess of the acids. In a second step, the product obtained in the first step is subsequently reacted with a monoalcohol to form the ester terminated polyamide.

The method for preparing ester-terminated oligomers comprises the reaction of a molar excess of carboxylic acid with an amine such as a diamine or triamine. The condensation product thus formed is then reacted with a monoalcohol.

Preferably, the ester-terminated oligomers are formed upon reaction of a dimer acid, a diacid, a diamine and a monoalcohol. The dimer acid, the diacid and the diamine will first react, whereafter the product obtained will be reacted with monoalcohol. In order to ensure that acid end groups will react with the monoalcohol, a molar excess of acids is used in the first step.

In such an embodiment, the repeating units of the oligomer will be combinations of monomers of the diacid, the dimer acid and the diamine, and the ester end group is derived from acid end groups and the monoalcohol. In such an embodiment, the monomers of the diamine are suitably present in an amount in the range of from 1-20 wt. %, preferably in the range of from 4-8 wt. %, based on the total weight of the ester terminated oligomer. The monomers of the dimer acid are suitably present in an amount in the range of from 35-75 wt. %, preferably in the range of from 55-70 wt. %, based on total weight of the ester terminated oligomer; and the monomers of the diacid are suitably present in an amount in the range of from 2-40 wt. %, preferably in the range of from 2.5-9.5 wt. %, based on total weight of the ester terminated oligomer.

When both monomers of a dimer acid and a diacid are present, the number of the monomers of the dimer acid will suitably be larger than the number of the monomers of the diacid.

The ester terminated oligomer to be used in accordance with the present invention comprises a number of repeating units which are obtained from the condensation reaction of a carboxylic acid and an amine. The number of repeating units is in the range of from 1-20. Preferably, n is an integer in the range of from 2 to 14, more preferably an integer in the range of from 2 to 10, and even more preferably in the range of from 2 to 8.

The weight average molecular weight ratio between the R1—O groups used and the final condensation product obtained is at least between 0.010-0.50, and preferably in the range of from 0.011-0.30.

The molar ratio between the R2 hydrocarbon groups that are derived from a diacid and the R3 hydrocarbon groups that are derived from a diamine is preferably at least between 0.30-0.40 and more preferably in the range of from 0.36-0.38

In addition, the present invention relates to a method for preparing the grease composition according to the present invention, comprising the steps of:

(a) mixing the ester-terminated oligomer and the lubricating base oil in any possible order at a temperature above the melting points of the oligomer; and (b) cooling the mixture as obtained in step (a) to a temperature in the range of from 0-120° C. in less than 3 minutes.

Step (a) can suitably be carried out at a temperature in the range of from 150-250° C., preferably in the range of from 170-230° C., more preferably in the range of from 190-210° C. Step (a) can be carried out by mixing the oligomer, the lubricating base oil and optionally the polymer in a manner known per se, which can optionally involve the use of suitable solvents.

The ester-terminated oligomer is mixed with the lubricating base oil. After the oligomer is dissolved in the lubricating base oil and optionally additives have been added, the mixture so obtained is cooled from the mixing temperature to a temperature in the range of 0-120° C. in less than 3 minutes. Preferably, the mixture obtained in step (b) is cooled in step (b) to a temperature in the range of from 10-100° C., more preferably in the range of from 15-35° C., even more preferably to room temperature. Suitably, the cooling in step (b) is carried out in a period of time between 1 sec.-2 min., preferably 10 sec.-1 min., more preferably about 5-15 sec. This rapid cooling process, which forms an important aspect of forming the grease composition, will be indicated hereinafter as "quenching". The quenching of the mixture as obtained in step (a) can be carried out, for instance, by pouring the grease composition on a metal plate, although any other suitable rapid cooling method may also be used, such as spraying. The quenching process has a major influence on the structure of grease composition, giving significant improvement of the properties of the final liquid lubricating oil compositions compared to both conventional lubricating oil compositions. The mixing process is preferably carried out under a protective atmosphere, such as a nitrogen gas flow, in order to avoid oxidation of the polymer components and the oils during heating.

The preparation of the present grease composition is preferably carried out under a protective atmosphere, such as a nitrogen gas flow, in order to avoid oxidation of the oils during heating.

The grease composition in accordance with the present invention displays unique reversible properties at different shear rates. This is due to the fact that the thickener has the advantage that it becomes a liquid at a high shear rate, whereas it regains its solid form at a low shear rate, resulting in a proper lubricating performance over an extended period of time.

Accordingly, the present invention also relates to a grease composition obtainable by the method according to the present invention.

The present invention further relates to the use of a grease composition according to the present invention for lubricating a mechanical component having a metal surface. In addition, the present invention relates to the use of the present liquid lubricating oil composition for protecting a mechanical component having a metal surface against corrosion, wear and/or fretting. Suitably, the mechanical component comprises a bearing, bearing component or gearbox component. The present invention further relates to a grease composition obtainable according to the method of the invention.

The lubricating base oil to be used in the present grease composition may be selected from the group consisting of mineral base oils and synthetic base oils. Mineral base oils are derived from crude oils and are either formulated on the basis of aromatic, paraffinic and/or naphthenic base oils. Further, a wide range of synthetic base oils can be used and include for instance esters, poly-alpha-olefins and polysiloxanes.

The lubricating base oil to be used in accordance with the present invention may also comprise a base oil blend. Suitably, blends of mineral base oils and/or synthetic base oils may be used.

The lubricating base oil to be used in the grease composition of the invention is one which may ordinarily be used as the base oil of a lubricating oil or as the base oil of a grease, but will suitably have a kinematic viscosity at 40° C. in the range of from 5-1000 cSt, preferably in the range of from 10-400 cSt.

Also the lubricating base oils may be any lubricating oils known per se such as mineral oils, synthetic hydrocarbons, ester oils, vegetable oils and mixtures thereof.

In the context of the present application the kinematic viscosity measurements at 40° C. are carried out in accordance with DIN 51562/1.

Furthermore, additives known per se may be incorporated in the present grease composition. The grease composition may additionally comprise at least one additive component which is selected from the group consisting of antioxidants, corrosion inhibitors, anti-wear agents and pressure tolerance-increasing additives, and wherein the total content of the additive component(s) is in the range between 0.1 and 15% by weight, and preferably between 0.5 and 10% by weight, based on the total weight of the grease composition. The present invention also relates to the present grease composition which further comprises one or more anti-wear, anti-corrosion and/or anti-fretting additives.

An advantage of the present grease composition is that the amount of such additives, in particular aggressive additives, can be decreased or even be avoided, whilst still very attractive lubricating properties are established.

EXAMPLES

Example 1 (According to the Invention)

In a reaction vessel, 20 gram of a commercially available ester terminated oligomer polyamide was heated to its melting point of around 160° C. in the presence of dry nitrogen and under continuous stirring. 80 gram of lubricating ester base oil Priolube® 1851 (available from Croda Lubricants) was subsequently slowly added and the temperature was not allowed to cool down to below 145° C. The temperature of the reaction mixture was then raised to 180° C. and kept under dry nitrogen and continuous stirring for about 60 minutes. The temperature was then further raised to 205° C. and kept under dry nitrogen, whilst the mixture was continuously stirred for 30 minutes. The thus-obtained reaction mixture was then cooled to room temperature within 10 seconds by quenching with room temperature water. The grease obtained in this way had the following properties:

NLGI Grade: 3 (237 mm-1, after 60 strokes) [measured according to DIN 51804]

Dropping point: 78° C.

Solubility in oil: Soluble in oil (Visual Appearance)

Subsequently, the grease so obtained was subjected to a Shell roll stability test at 80° C. for 50 hours, after which the NLGI Grade was again measured. The subsequently measured grade corresponded very closely to the NLGI Grade of the un-worked grease. This finding shows the very attractive reversible properties of the grease composition of the present invention.

Example 2 (According to the Invention)

In a reaction vessel, 20 gram of an ester terminated oligomer as used in Example 1was heated to its melting point of around 160° C. in the presence of dry nitrogen and under continuous stirring. The terminated oligomer polyamide was prepared by mixing 61 gram of a dimer derived from fatty acid with 7.4 gram of azeliac acid and 25.7 gram of stearyl alcohol. The temperature of the reaction mixture was raised to 95° C. 5.9 gram of ethylene diamine was then added slowly to the reaction mixture drop by drop with constant stirring under dry nitrogen supply. After the completion of the diamine addition, the temperature of the reaction mixture was raised to 180° C. for 3 hours. Subsequently, the temperature of the reaction mixture was raised to 205° C. and the reaction mixture was kept under constant dry nitrogen supply and the mixture was constantly stirred for 30 minutes. After completion of the 30 minutes of stirring, the reaction mixture was poured onto a quenching plate. 80 gram of lubricating ester base oil Priolube® 1851 (available from Croda Lubricants) was then added slowly to the quenched reaction mixture and the temperature was not allowed to cool down to below 145° C. The temperature of the reaction mixture was then raised to 180° C. and kept under dry nitrogen and continuously stirring for 60 minutes. The temperature was then further raised to 205° C. and kept under dry nitrogen, whilst the mixture was continuously stirred for 30 minutes. The thus-obtained reaction mixture was then cooled to room temperature within 10 seconds by quenching with room temperature water. The grease obtained in this way had the following properties:

NLGI Grade: 2 (283 mm-1, after 60 strokes) [measured according to DIN 51804]

Dropping point: 141° C.

Solubility in oil: Completely soluble (Visual Appearance)

Subsequently, the grease so obtained was subjected to a Shell roll stability test at 80° C. for 50 hours, after which the NLGI Grade was again measured. The subsequently measured grade corresponded very closely to the NLGI Grade of the un-worked grease. This finding shows the very attractive reversible properties of the grease composition of the present invention.

Example 3 (Comparative Example)

In a reaction vessel, 20 gram of the same ester terminated oligomer as used in Example 2 was heated to its melting point of around 160° C. in the presence of dry nitrogen and under continuous stirring. 80 gram of lubricating ester base oil Priolube® 1851 was added slowly and the temperature was not allowed to cool down to below 145° C. The temperature of the reaction mixture was then raised to 180° C. and kept under dry nitrogen and continuously stirring for 60 minutes. The temperature was then further raised to 205° C. and kept under dry nitrogen, whilst the mixture was continuously stirred for 30 minutes. The thus-obtained reaction mixture was then cooled to room temperature without any quenching and any time limit (more than 180 minutes). A grease structure was, however, not formed, even though there was gel structure in an early stage. At a later stage, the gel was separated into oil and oligomer. Hence, this example shows that the rapid cooling in step (b) of the method of the present disclosure is of essential importance.

Example 4 (Comparative Example)

A terminated oligomer polyamide was prepared by mixing 47.5 gram of a dimer derived from fatty acid with 28 grams of azeliac acid and 15 grams of stearyl alcohol. The temperature of the reaction mixture was then raised to 95° C. 9.5 gram of ethylene diamine was subsequently slowly added to the reaction mixture drop by drop under constant stirring and under dry nitrogen supply. After the completion of the diamine addition, the temperature of the reaction mixture was raised to 180° C. for 3 hours. The temperature of the reaction was then raised to 205° C. and kept under constant dry nitrogen supply and constant stirring for 30 minutes. After completion of 30 minutes the reaction mixture was poured onto a quenching plate. In a reaction vessel, 20 gram of the thus-obtained ester terminated oligomer was then heated to its melting point of around 160° C. in the presence of dry nitrogen and under continuous stirring. 80 gram of lubricating ester base oil Priolube® 1851 (available from Croda) was subsequently slowly added and the temperature was not allowed to cool down to below 145° C. The temperature of the reaction mixture was then raised to 180° C. and kept under dry nitrogen and continuously stirring for 60 minutes. The temperature was then further raised to 205° C. and kept under dry nitrogen, whilst the mixture was continuously stirred for 30 minutes. The thus-obtained reaction mixture was then cooled to room temperature within 10 seconds by quenching with room temperature water.

A grease was not obtained and oil was completely insoluble as per visual appearance.

This finding shows that when the ester-terminated oligomer contains R2 hydrocarbons groups that are derived from dimer acids and R2 hydrocarbon groups that are derived from diacids, the molar ratio between the dimer acids and diacids of R2 hydrocarbon groups is preferably larger than 2 and more preferably between 2.5 to 2.9.

What is claimed is:

1. A grease composition comprising a mixture of:

a thickener; and a lubricating base oil, wherein:

the lubricating base oil has a viscosity of 5-1000 cSt at 40° C., the thickener constitutes 5-40 wt.% of the total weight of the grease composition, the thickener comprises an ester-terminated polyamide having the formula:

$$R1—O—CO—R2—CO—[NH—R3—NH—CO—R2—CO]_n—O—R1,$$

wherein:

each R1 is independently a linear or branched, saturated or unsaturated, substituted or unsubstituted hydrocarbon group containing 4-22 carbon atoms, each R2 is independently a linear or branched, saturated or unsaturated, substituted or unsubstituted hydrocarbon group containing 4-42 carbon atoms, each R3 is independently a linear or branched, saturated or unsaturated, substituted or unsubstituted hydrocarbon group containing 2-9 carbon atoms, n is an integer in the range of 2-20, and the lubricating base oil and the ester-terminated polyamide are present in a weight ratio (oil/oligomer) that is larger than 1.

2. The grease composition according to claim 1, comprising:

(a) 75 to 90 wt% of the lubricating base oil; and (b) 10 to 25 wt% of the ester-terminated polyamide, wherein all weights are based on the total weight of the grease composition, and wherein the grease composition has an NLGI grade of 2 or 3.

3. The grease composition according to claim 1, wherein:

the —CO—R2—CO— groups are derived from both dimer acids and diacids, and a molar ratio (A/B) of the —CO—R2—CO— groups derived from the dimer acid (A) to the —CO—R2—CO— groups from the diacid (B) is larger than 1.

4. The grease composition according to claim 3, wherein the molar ratio (A/B) is larger than 2.

5. The grease composition according to claim 3, wherein the molar ratio (A/B) is between 2.5 and 2.9.

6. The grease composition according to claim 3, wherein the —NH—R3—NH— group is derived from one of an ethylene diamine or a hexamethylene diamine.

7. The grease composition according to claim 3, wherein the dimer acid is derived from two molecules of unsaturated fatty acids that each contain 14 to 22 carbon atoms.

8. The grease composition according to claim 3, wherein the diacid is derived from one of: an adipic acid, an azelaic acid or a sebacic acid.

9. The grease composition according to claim 3, wherein R1 is derived from one of stearyl alcohol or oleyl alcohol.

10. A grease composition comprising a mixture of:

a thickener; and a lubricating base oil, wherein:

the lubricating base oil has a viscosity of 5-1000 cSt at 40° C., the thickener constitutes 5-40 wt.% of the total weight of the grease composition, the thickener comprises an ester-terminated polyamide having the formula:

$$R1—O—CO—R2—CO—[NH—R3—NH—CO—R2—CO]_n\text{-}O—R1,$$

each R1 is independently a linear or branched, saturated or unsaturated, substituted or unsubstituted hydrocarbon group containing 4-22 carbon atoms, each R2 is independently a linear or branched, saturated or unsaturated, substituted or unsubstituted hydrocarbon group containing 4-42 carbon atoms, each R3 is independently a linear or branched, saturated or unsaturated, substituted or unsubstituted hydrocarbon group containing 2-9 carbon atoms, n is 2 to 14, the lubricating base oil and the ester-terminated polyamide are present in a weight ratio (oil/oligomer) that is larger than 1, and the grease composition has an NLGI grade of 2 or 3.

11. The grease composition according to claim 1, wherein n is 2 to 10.

12. The grease composition according to claim 5, wherein:

the —NH—R3—NH— group is derived from one of an ethylene diamine or a hexamethylene diamine;

the dimer acid is derived from two conjugated molecules of fatty acids that each contain 14 to 22 carbon atoms, the diacid is derived from one of an adipic acid, an azelaic acid or a sebacic acid; and R1 is derived from one of stearyl alcohol or oleyl alcohol.

13. The grease composition according to claim 12, wherein at least 50% of the R2 groups have 30-42 carbon atoms.

14. The grease composition according to claim 13, wherein less than 30% of the R2 groups have 4-12 carbon atoms.

15. The grease composition according to claim 14, wherein the lubricating base oil is an ester oil having a viscosity in the range of 40-400 cSt at 40° C.

16. The grease composition according to claim 15, wherein:

the thickener constitutes 18-22 wt.% of the total weight of the grease composition, R1 is an unsubstituted, saturated, linear hydrocarbon having 18 carbons, R3 is an unsubstituted, saturated, linear hydrocarbon having 2 carbons, less than 30% of the R2 groups are an unsubstituted, saturated, linear hydrocarbon having 7 carbons.

17. The grease composition according to claim 16, wherein the ester- terminated polyamide has an acid number less than 15.

18. The grease composition according to claim 1, produced by a process comprising:

under a protective atmosphere, mixing the ester-terminated polyamide and the lubricating base oil in any order without introducing any water and holding the mixture at a temperature above the melting point of the ester terminated polyamide, and cooling the resulting mixture to 0-120° C. in less than 3 minutes.

19. The grease composition according to claim 18, wherein the mixture is held at a temperature of 190-210° C. and then the resulting mixture is cooled to a temperature of 15-35° C. within 5-15 seconds.

20. The grease composition according to claim 19, wherein:

the —CO—R2—CO— groups are derived from both dimer acids and diacids, a molar ratio (A/B) of the —CO—R2—CO— groups derived from the dimer acid (A) to the —CO—R2—CO— groups from the diacid (B) is larger than 1, and the molar ratio (A/B) is between 2.5 and 2.9.

* * * * *